US007683543B2

(12) United States Patent
Hwang

(10) Patent No.: US 7,683,543 B2
(45) Date of Patent: Mar. 23, 2010

(54) PLASMA DISPLAY PANEL WITH IMPROVED BARRIER RIBS

(75) Inventor: Tae Su Hwang, Gumi-si (KR)

(73) Assignee: LG Electronics Inc., Seoul (KR)

( * ) Notice: Subject to any disclaimer, the term of this patent is extended or adjusted under 35 U.S.C. 154(b) by 131 days.

(21) Appl. No.: 11/318,569

(22) Filed: Dec. 28, 2005

(65) Prior Publication Data

US 2006/0163993 A1 Jul. 27, 2006

(30) Foreign Application Priority Data

Dec. 29, 2004 (KR) ..... 10-2004-0115705

(51) Int. Cl.
*H01J 17/49* (2006.01)

(52) U.S. Cl. ..... 313/582; 313/587

(58) Field of Classification Search ..... 313/582–587
See application file for complete search history.

(56) References Cited

U.S. PATENT DOCUMENTS

| | | | | |
|---|---|---|---|---|
| 6,242,859 | B1 * | 6/2001 | Betsui et al. | 313/584 |
| 2002/0003406 | A1 * | 1/2002 | Kang et al. | 313/587 |
| 2003/0184229 | A1 * | 10/2003 | Kim et al. | 313/587 |
| 2004/0075389 | A1 * | 4/2004 | Kim et al. | 313/587 |
| 2004/0091672 | A1 * | 5/2004 | Ahn et al. | 428/156 |
| 2004/0135508 | A1 * | 7/2004 | Kwon et al. | 313/582 |
| 2004/0201351 | A1 * | 10/2004 | Woo et al. | 313/582 |
| 2005/0082958 | A1 * | 4/2005 | Su et al. | 313/292 |
| 2005/0212182 | A1 * | 9/2005 | Yokoyama et al. | 264/496 |
| 2006/0043894 | A1 * | 3/2006 | Kim et al. | 313/586 |
| 2006/0071594 | A1 * | 4/2006 | Moon et al. | 313/582 |
| 2006/0091802 | A1 * | 5/2006 | Hong et al. | 313/582 |
| 2006/0139241 | A1 * | 6/2006 | Horikawa et al. | 345/60 |
| 2006/0225463 | A1 * | 10/2006 | Sugimoto et al. | 65/31 |

FOREIGN PATENT DOCUMENTS

| | | | |
|---|---|---|---|
| JP | 2001-236890 | A | 8/2001 |
| KR | 10-2004-0023992 | A | 3/2004 |

* cited by examiner

*Primary Examiner*—Bumsuk Won
(74) *Attorney, Agent, or Firm*—Birch, Stewart, Kolasch & Birch, LLP

(57) ABSTRACT

The present invention relates to a plasma display panel. According to the present invention, a width of an inner barrier rib formed in an inner region within a display region of a rear substrate is smaller than a width of an outer barrier rib formed in an outer region of the rear substrate. Therefore, the barrier ribs can be prevented from being damaged due to pressure applied when a front substrate and the rear substrate are adhered. Furthermore, a height of the inner barrier rib and a height of the outer barrier rib are substantially the same. It is thus possible to minimize noise incurred by a step between the barrier ribs.

7 Claims, 8 Drawing Sheets

PLASMA DISPLAY PANEL WITH IMPROVED BARRIER RIBS

BACKGROUND OF THE INVENTION

1. Field of the Invention

The present invention relates to a plasma display panel, and more particularly, to the structure of barrier ribs formed on a rear substrate and a plasma display panel in which barrier ribs are formed.

2. Discussion of Related Art

In general, a plasma display panel apparatus includes discharge cells formed between a rear substrate having barrier ribs formed therein and a front substrate opposite to the rear substrate. The plasma display panel apparatus implements images by light-emitting phosphors with vacuum ultraviolet rays generated when an inert gas within each of the discharge cells is discharged by a high frequency voltage.

FIG. 1 is a plan view of electrodes formed in a general plasma display panel. FIG. 2 is a cross-sectional view of a discharge cell of the general plasma display panel.

The discharge cell is formed on a rear substrate 18 opposite to a front substrate 10 by a plurality of barrier ribs 24 partitioning discharge spaces.

An address electrode 12X is formed on the rear substrate 18. Scan electrodes 12Y and sustain electrodes 12Z are formed in pairs on the front substrate 10. As shown in FIG. 1, the address electrode 12X cross the scan electrodes 12Y and the sustain electrodes 12Z. The rear substrate 18 shown in FIG. 2 is rotated by 90°.

A dielectric layer 22 for accumulating wall charges is formed on the rear substrate 18 having the address electrode 12X formed therein.

The barrier ribs 24 are formed on the dielectric layer 22, forming the discharge spaces between the barrier ribs. The barrier ribs 24 prevent ultraviolet rays generated by a discharge and a visible ray from leaking to neighboring discharge cells. Phosphors 26 are coated on surfaces of the dielectric layer 22 and the barrier ribs 24.

An inert gas is injected into the discharge space. The phosphors 26 are excited by ultraviolet rays generating during a discharge of the gas, generating one of red, green and blue visible rays.

Each of the scan electrodes 12Y and the sustain electrodes 12Z formed in the front substrate 10 includes a transparent electrode 12*a* and a bus electrode 12*b*. The scan electrodes 12Y and the sustain electrodes 12Z cross the address electrode 12X. A dielectric layer 14 and a protection film 16 covering the scan electrodes and the sustain electrodes are also formed on the front substrate 10.

The discharge cell constructed above is selected by a counter discharge between the address electrode 12X and the scan electrodes 12Y, and then has its discharge sustained by a surface discharge between the scan electrodes and the sustain electrodes 12Y, 12Z, thus radiating a visible ray.

FIG. 3 shows the structure of barrier ribs formed in a rear substrate of the general plasma display panel.

A region on the rear substrate 18 may be classified into a display region on which images are displayed, and a non-display region on which images are not displayed. A plurality of barrier ribs 24 is formed in the display region in lattice form. A Side Barrier Rib (hereinafter referred to as "SBR") 30 is formed on the non-display region.

The SBR 30 is disposed within the non-display region. The SBR 30 functions to prevent sealing paste or material for adhering the front substrate 10 and the rear substrate 18 from entering the display region and also to prevent the barrier ribs 24 within the display region from being damaged by pressure applied for adhesion.

At this time, the barrier ribs 24 formed on the display region has a step in which the height of central barrier ribs is lower than the height of outer barrier ribs in a manufacturing process. The SBR 30 also has a step with the central barrier ribs. Therefore, problems arise because the adhesion density of the substrate is decreased and noise is generated in the panel.

Furthermore, the central barrier ribs of the display region do not isolate the respective discharge spaces due to the steps of the barrier ribs 24 and the SBR 30. This results in crosstalk fail.

SUMMARY OF THE INVENTION

Accordingly, the present invention has been made in view of the above problems, and it is an object of the present invention to provide a plasma display panel in which a width of outer barrier ribs formed in the outer block of a display region of a rear substrate is set to be wider than that of inner barrier ribs formed within the outer block, thus saving a manufacturing process of forming a SBR in a non-display region and cost accordingly.

Furthermore, the present invention can prevent barrier ribs from being damaged due to pressure applied when a front substrate and a rear substrate are adhered and can also minimize noise occurring due to the step of the barrier ribs.

In this case, the outer barrier ribs may refer to a plurality of barrier ribs arraigned in a horizontal or vertical direction in the outer block of the display region adjacent to the non-display region. The inner barrier ribs may refer to a plurality of barrier ribs arranged in a horizontal or vertical direction within the outer block. At this time, the outer barrier ribs can also extend up to the non-display region and can be formed therein.

Furthermore, the outer barrier ribs can have a wider width with them becoming more distant from the central region of the rear substrate.

A width of the outer barrier ribs can be formed 1.5 times to 200 times wider than that of the inner barrier ribs, and can be set in the range of 45 μm to 30000 μm. At this time, a width to be compared is an upper width of the barrier ribs.

Furthermore, the outer barrier ribs can have substantially the same height as that of the inner barrier ribs.

DETAILED DESCRIPTION OF PREFERRED EMBODIMENTS

The structure of barrier ribs and a plasma display panel having the barrier rib structure according to the present invention will now be described in connection with embodiments with reference to the accompanying drawings.

Embodiment of the plasma display panel according to the present invention may be plural. A preferred embodiment will be described below.

Hereinafter, a preferred embodiment of the present invention will be described in detail with reference to FIGS. 4 to 9.

Figure 4:
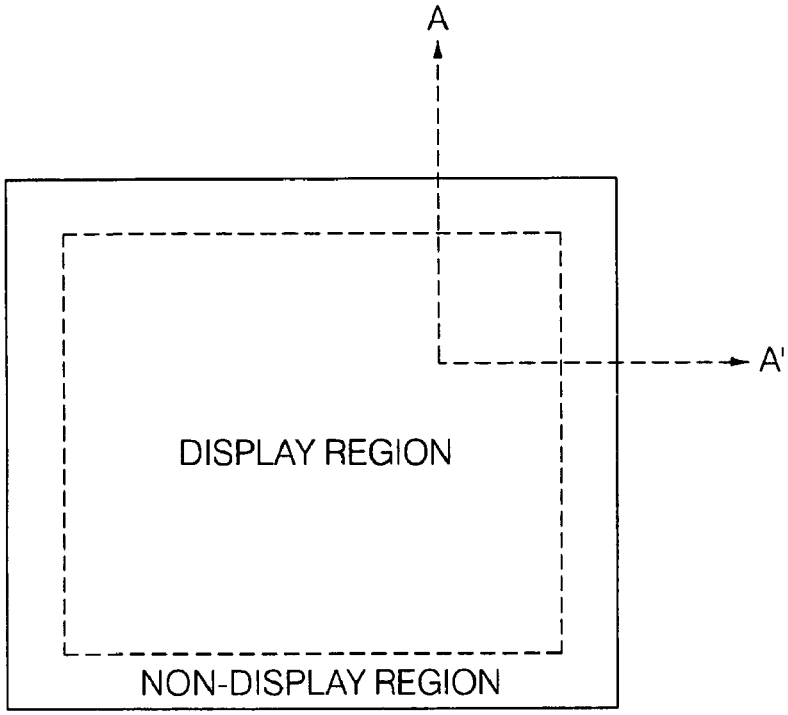
FIG. 4 is a view showing a display region of a plasma display panel according to the present invention.

FIG. 4 is a view for dividing a region in a plasma display panel according to the present invention. A region on which images are displayed will be referred to as a display region and a region outside the display region will be referred to as a non-display region.

Though barrier ribs are formed in the display region and the non-display region, phosphors are coated on the barrier ribs within the display region, so that images are displayed on the display region. However, phosphors are not coated on the barrier ribs within the non-display region, so that images are not displayed on the non-display region.

Therefore, the display region shown in FIG. 4 is not limited to a rectangular shape indicated by a dotted line. Widths in top and bottom sides and both sides of the non-display region can be asymmetrical to each other.

The construction of the plasma display panel in which the region is divided as described above will be first described below in short.

In a front substrate, scan electrodes and sustain electrodes are formed in pairs. The scan electrodes and the sustain electrodes cross an address electrode formed in a rear substrate. Furthermore, each of the scan electrodes and the sustain electrodes includes a transparent electrode formed of transparent conductive metal and a bus electrode formed of conductive metal.

Furthermore, in the front substrate is formed a dielectric layer covering the scan electrodes and the sustain electrodes. A protection film can also be laminated on the dielectric layer.

In the rear substrate is formed the address electrode. A dielectric layer covering the address electrode is formed in the rear substrate. A plurality of barrier ribs that partition discharge spaces is formed on the dielectric layer. Phosphors are coated on surfaces of the dielectric layer and the barrier ribs.

The barrier ribs function to prevent ultraviolet rays generated by a discharge and a visible ray from leaking to neighboring discharge cells, so that crosstalk is not generated. The barrier ribs are adhered to the front substrate.

An inert gas is injected into the discharge spaces provided between the rear substrate and the barrier ribs. The phosphors are excited with ultraviolet rays generated during a discharge of the gas, generating a visible ray. Any one of red (R), green (G) and blue (B) colors is represented.

Figure 5:
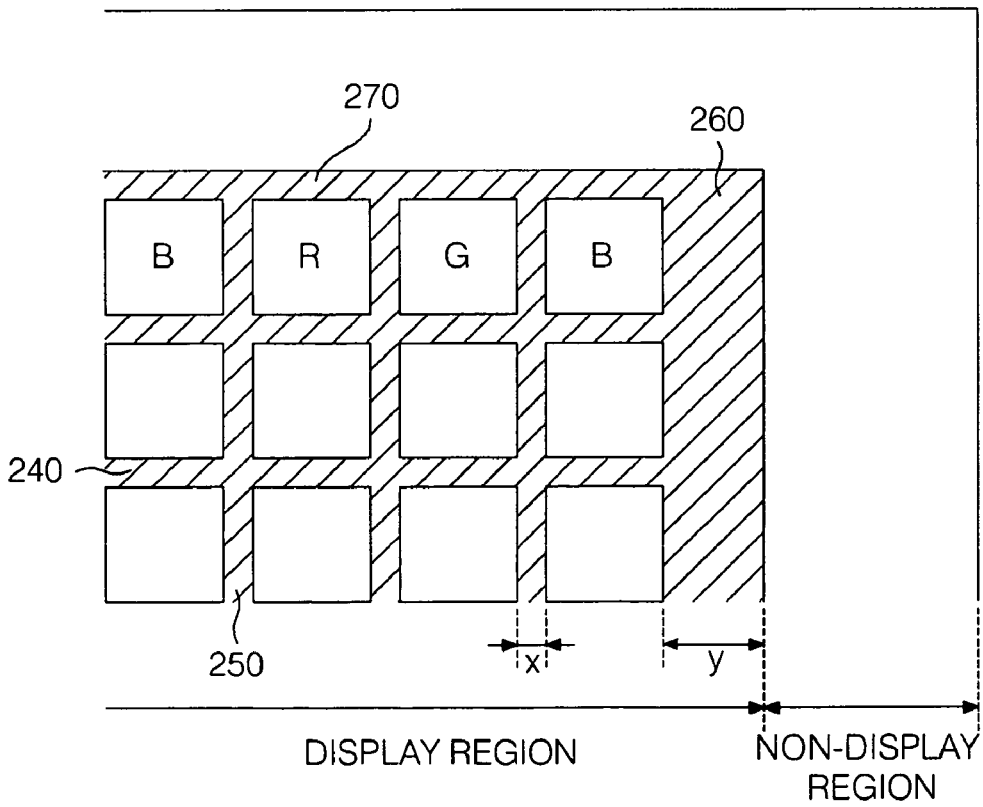
FIG. 5 shows a first embodiment of a plasma display panel according to the present invention.

FIG. 5 is a plan view of the rear substrate taken along line A-A' in the plasma display panel shown in FIG. 4. A barrier rib structure of the first embodiment will be described with reference to FIG. 5. In FIG. 5, a hatched portion indicates a plan view of a top surface of the barrier ribs.

In the first embodiment, barrier ribs 240, 250, 260 and 270 that partition discharge spaces are formed on the rear substrate within the display region.

Figure 1:
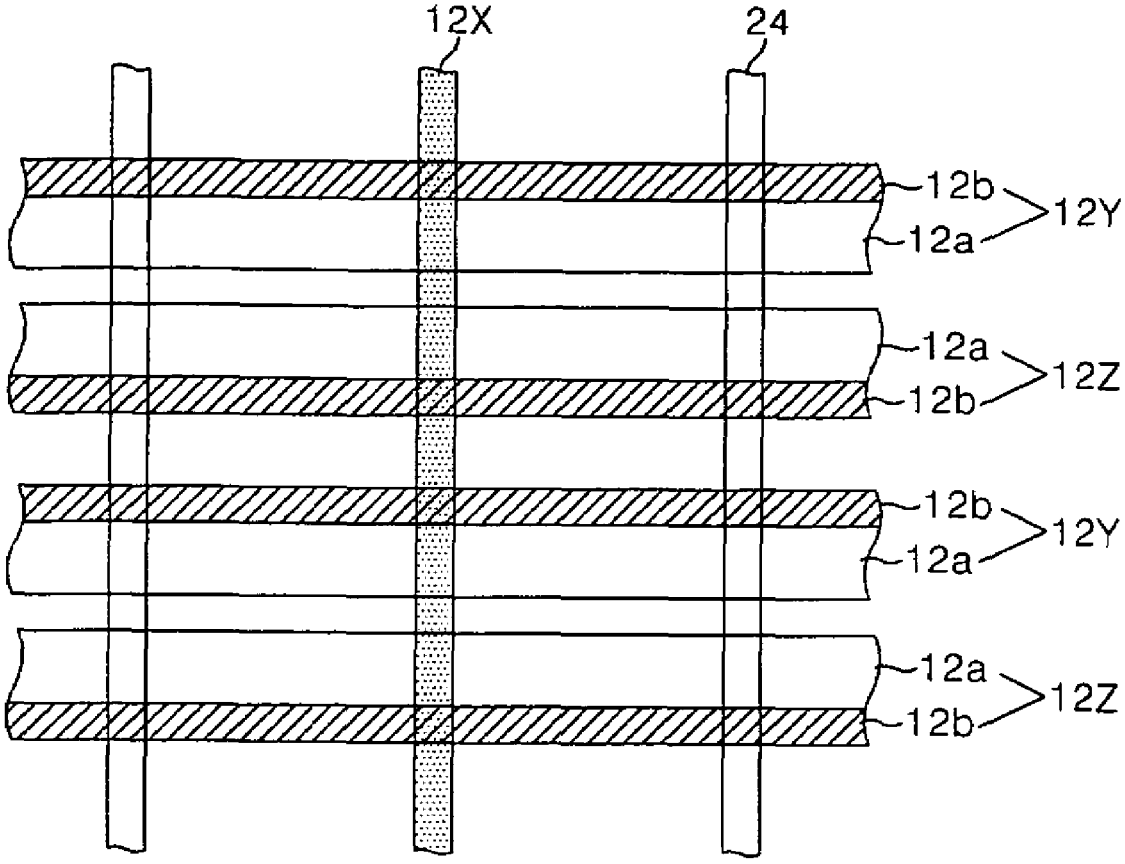
FIG. 1 (Prior Art)
FIG. 1 is a plan view of electrodes formed in a general plasma display panel.
Figure 2:
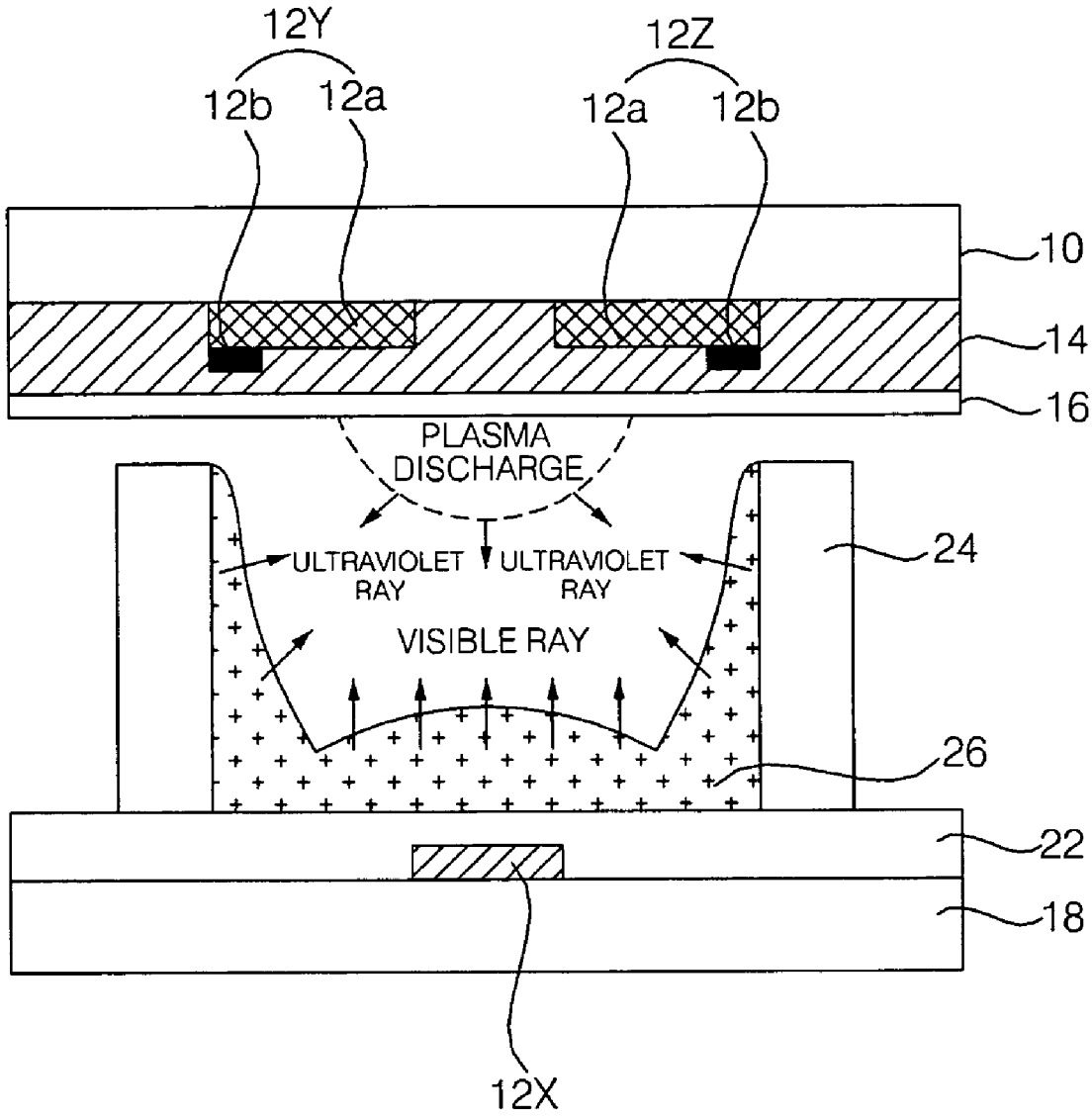
FIG. 2 (Prior Art)
FIG. 2 is a cross-sectional view of a discharge cell of the general plasma display panel.
Figure 3:
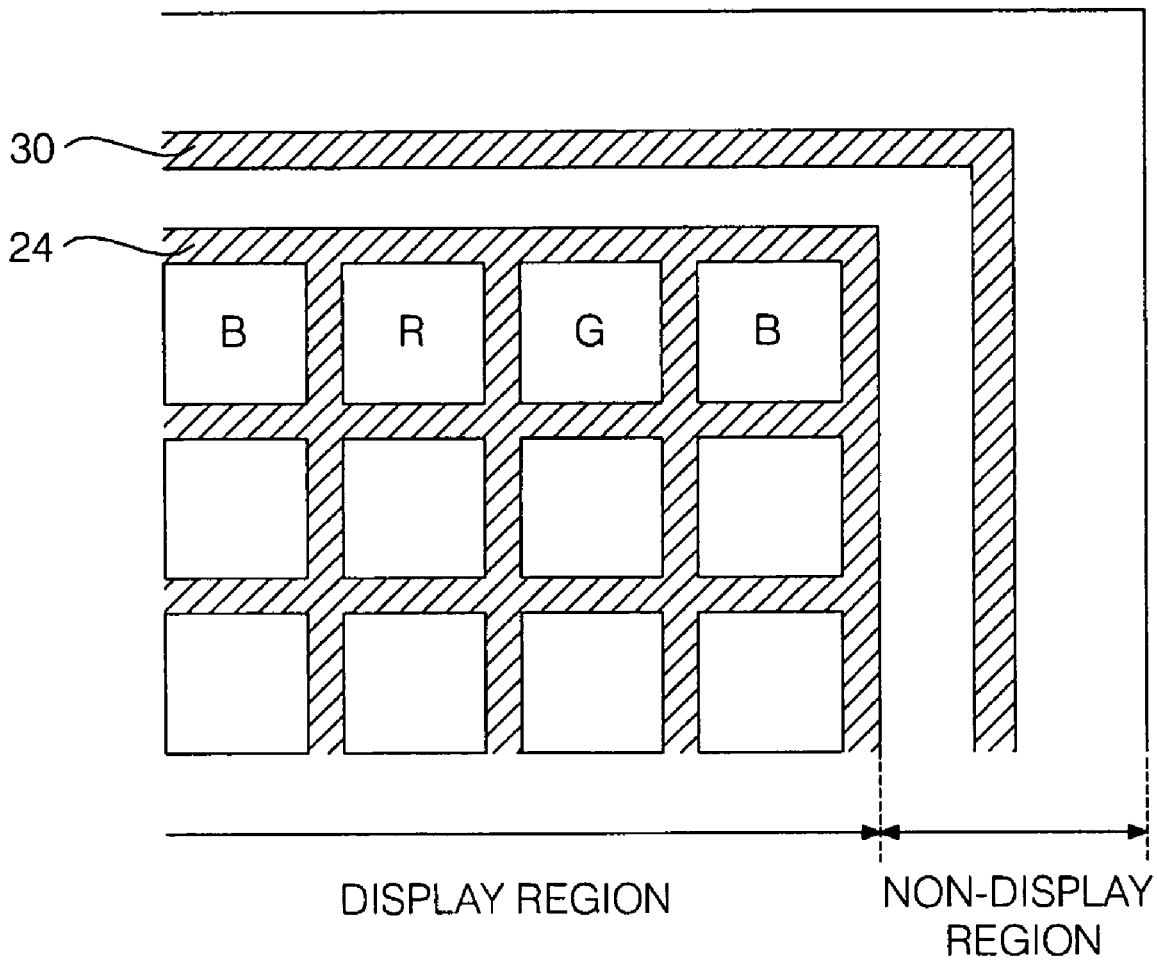
FIG. 3 (Prior Art)
FIG. 3 shows the structure of barrier ribs formed in a rear substrate of the general plasma display panel.

In this case, the barrier ribs located within the outer block of the display region will be referred to as the inner barrier ribs 240, 250. The barrier ribs located in the outer block will be referred to as the outer barrier ribs 260, 270. Furthermore, in the inner barrier ribs 240, 250 and the outer barrier ribs 260, 270, barrier ribs formed parallel to the scan electrodes 12Y and the sustain electrodes 12Z shown in FIG. 1 will be referred to as the traverse inner barrier ribs 240 and the traverse outer barrier ribs 270. Barrier ribs parallel to the address electrode 12X shown in FIG. 1 will be referred to as the longitudinal inner barrier ribs 250 and the longitudinal outer barrier rib 260.

A width (y) of the longitudinal outer barrier rib 260 of the outer block is set to be wider than a width (x) of the longitudinal inner barrier ribs 250 and thus replaces the function of SBR that was separately formed in the non-display region in the related art. Therefore, the SBR does not exist on the non-display region, as shown in FIG. 5.

Meanwhile, FIG. 5 is a plan view of part of the rear substrate. The longitudinal outer barrier rib 260 indicates a barrier rib located at the right outer block of the rear substrate. A longitudinal outer barrier rib (not shown) located at the left outer block of the rear substrate, which corresponds to the longitudinal outer barrier ribs 260, is formed to have substantially the same width (y) of the barrier ribs.

Meanwhile, the traverse outer barrier ribs 270 have substantially the same width as that of the plurality of traverse inner barrier ribs 240. The longitudinal inner barrier ribs 250 have substantially the same width (x).

A width of the barrier ribs refers to a top width that directs toward the front substrate. When considering the level of current manufacturing technology, the width (x) of the longitudinal inner barrier ribs 250 can be set in the range of approximately 30 to 60 μm and the width (y) of the longitudinal outer barrier rib 260 can be set within a range of approximately 45 to 30000 μm.

The reason why the lowest width of the longitudinal outer barrier rib 260 is set to 45 μm is that if the width is less than 45 μm, barrier ribs located at the outer block unit may be damaged by pressure applied in the process of adhering the substrates.

Furthermore, the reason why the highest width of the longitudinal outer barrier rib 260 is set to 30,000 μm is that if the width exceeds 30000 μm, a top shape of barrier ribs may be deformed because heat is irregularly transferred to the barrier ribs located at the outer block unit in a sintering process of the rear substrate. If the top shape of the barrier ribs is deformed as described above, there is a problem in a degraded picture quality due to crosstalk, etc.

That is, the width (y) of the longitudinal outer barrier rib 260 is set to be 1.5 to 200 times sufficiently wider than the width (x) of the longitudinal inner barrier ribs 250, so that it can bear pressure applied when the substrates are combined.

At this time, the inner barrier ribs 240, 250 and the outer barrier rib 260, 270 can have substantially the same height in order to prevent noise incurred by lattice. The term "substantially the same height" means that the heights of barrier ribs when substrates are combined together after a manufacturing process of the barrier ribs become the same.

Therefore, when considering that the height of barrier ribs in the outer block unit is inevitably higher than that of barrier ribs at the central unit in a manufacturing process, the outer barrier ribs 260, 270 can be formed to be lower than the inner barrier ribs 240, 250 taking error by the manufacturing process into consideration. In the above, the term "the height of the barrier ribs" refers to a height from the dielectric layer to the top of the barrier ribs. Furthermore, in the case where the longitudinal outer barrier ribs 260 are formed at the outermost block within the display region, phosphors may not be coated on one side directing toward the non-display region.

Figure 6:
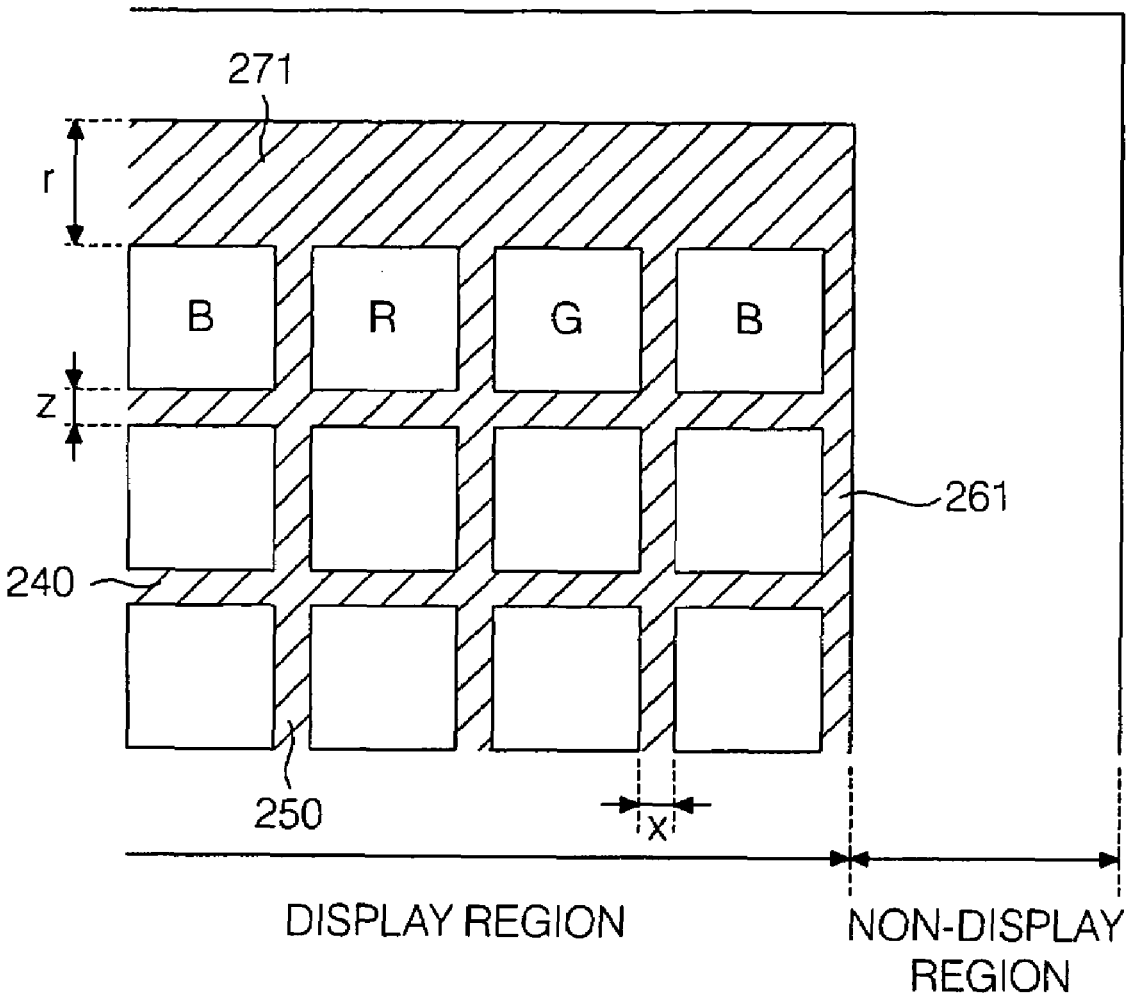
FIG. 6 shows a second embodiment of a plasma display panel according to the present invention.

FIG. 6 is a view for illustrating a barrier rib structure according to a second embodiment. In FIG. 6, a width of inner barrier ribs 240,250 is smaller than that of a traverse outer barrier rib 271. Therefore, overlapping description with the first embodiment will be omitted.

In FIG. 6, it has been shown that a width (z) of the traverse inner barrier ribs 240 and a width (x) of the longitudinal barrier ribs 250 are the same. However, the width (z) of the traverse inner barrier ribs 240 and the width (x) of the longitudinal barrier ribs 250 can be different from each other, if needed.

Therefore, in the second embodiment, the width (z) of the traverse inner barrier ribs 240 can be set in the range of approximately 30 to 60 μm and a width (r) of the traverse outer barrier rib 271 can be set in the range of approximately 45 to 30000 μm.

That is, the width (r) of the traverse outer barrier rib 271 is set to be 1.5 to 200 times sufficiently wider than the width (z) of the traverse inner barrier ribs 240, so that it can bear pressure applied when the substrates are combined.

Therefore, the plurality of longitudinal inner barrier ribs 250 and the longitudinal outer barrier ribs 261 have substantially the same width, and the traverse inner barrier ribs 240 also have substantially the same width.

Meanwhile, in the second embodiment, the traverse outer barrier rib 271 is a barrier rib located on an upper side of the rear substrate and has the same width as that of a traverse outer barrier rib (not shown) formed on a lower side of the rear substrate.

Figure 7:
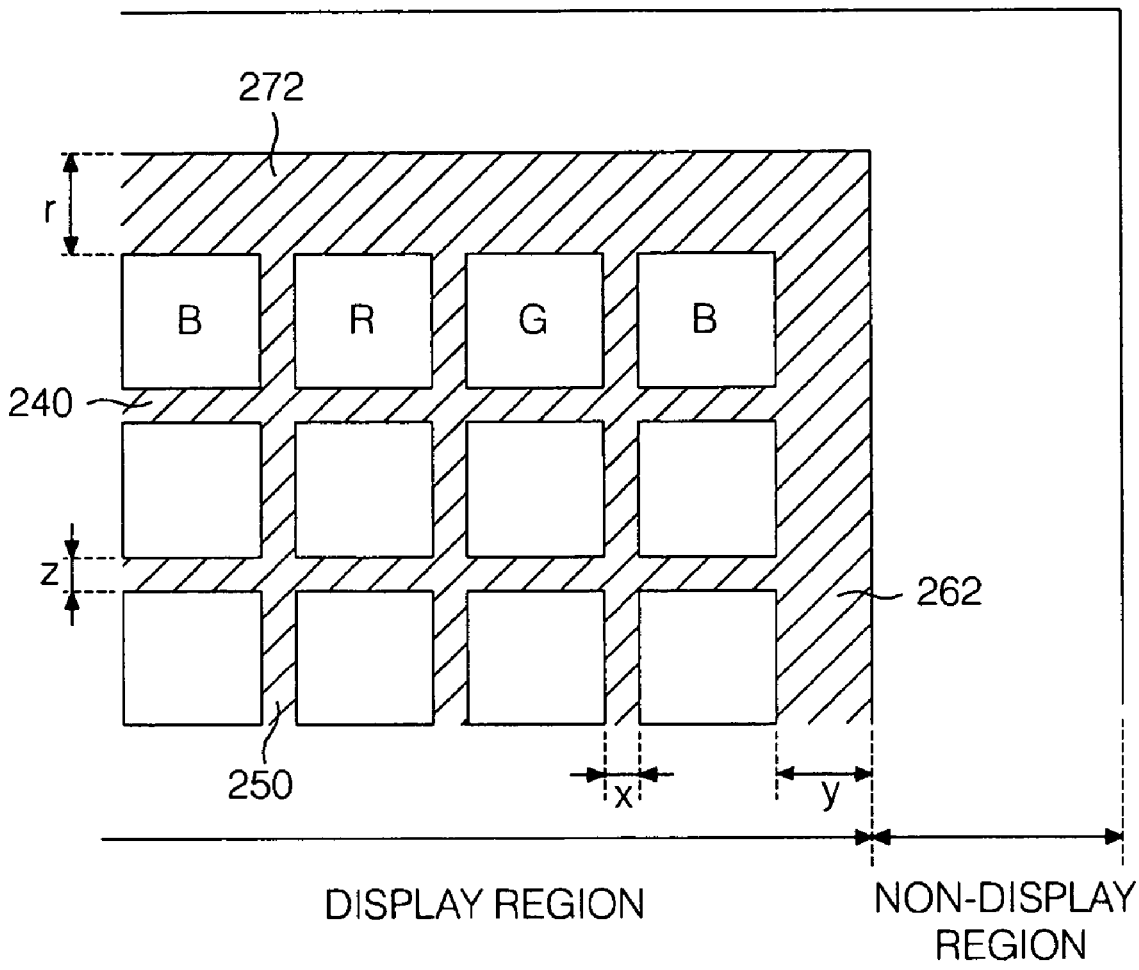
FIG. 7 shows a third embodiment of a plasma display panel according to the present invention.

FIG. 7 is a view for illustrating a barrier rib structure according to a third embodiment. In FIG. 7, outer barrier ribs having a width greater than that of inner barrier ribs 240,250 are a longitudinal outer barrier rib 262 and a traverse outer barrier rib 272.

Therefore, the longitudinal outer barrier rib 262 and the traverse outer barrier rib 272, which surround the outer block of the display region, have a width greater than that of the longitudinal inner barrier ribs 250 and the traverse inner barrier ribs 240. Therefore, when viewed from the plan view of the whole panel, the barrier rib structure of the present embodiment has a structure in which four sides of the display region are all surrounded by the outer barrier ribs 262, 272 having a width greater than that of the inner barrier ribs 240, 250.

The remaining portions of the third embodiment are the same as that of the first and second embodiments. Therefore, in the third embodiment, overlapping description with the first and second embodiments will be omitted.

Figure 8:
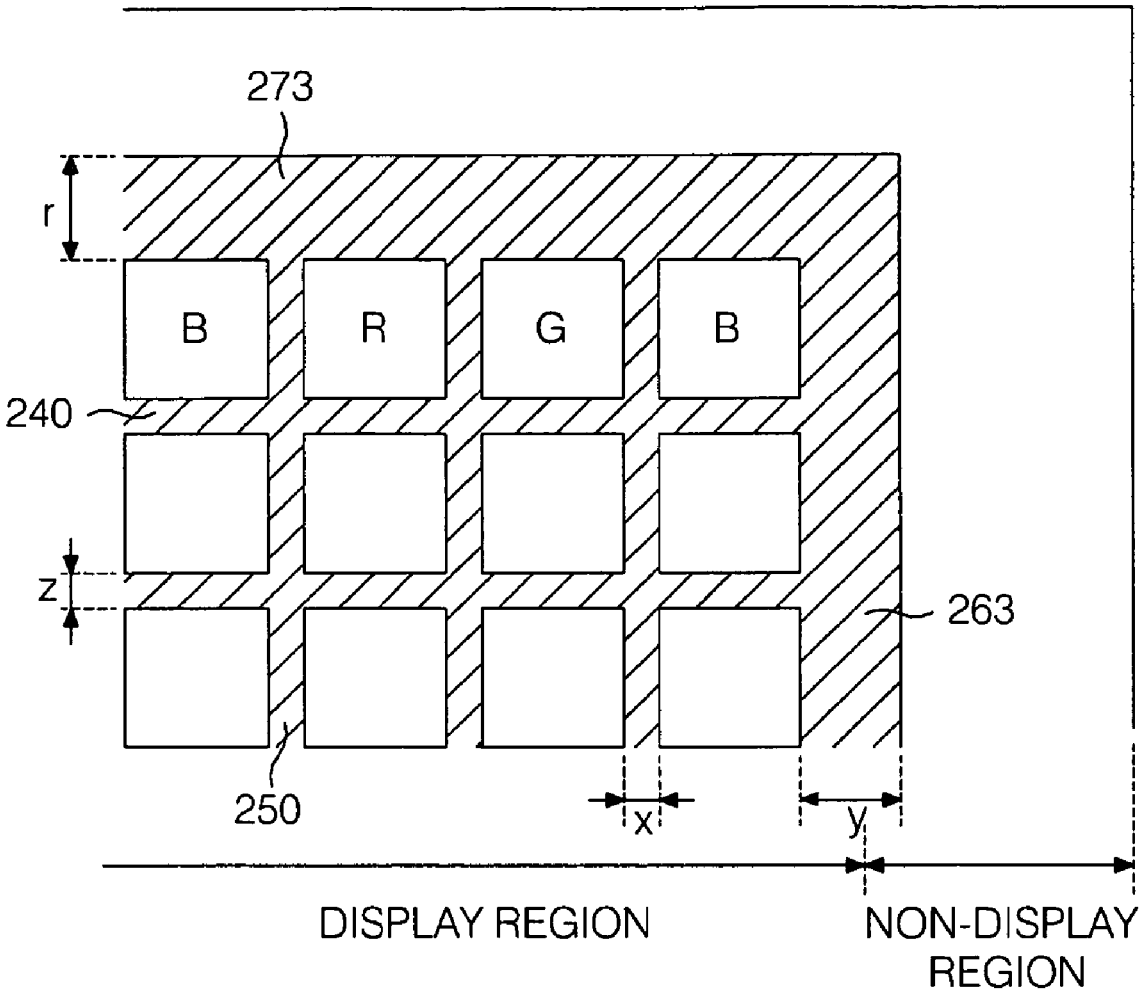
FIG. 8 shows a fourth embodiment of a plasma display panel according to the present invention.

FIG. 8 is a view for illustrating a barrier rib structure according to a fourth embodiment. In FIG. 8, outer barrier ribs 263,273 having a width greater than that of inner barrier ribs 240,250 are partially overlapped in a non-display region.

However, the outer barrier ribs that are partially overlapped in the non-display region can be longitudinal outer barrier ribs as in the first embodiment. At this time, a width (y) of the longitudinal outer barrier rib 263 can be formed to be 1.5 to 200 times wider than a width (x) of the longitudinal inner barrier rib 250.

Furthermore, the outer barrier ribs that are partially overlapped in the non-display region can be traverse outer barrier ribs as in the second embodiment. At this time, a width (r) of the traverse outer barrier rib 273 can be formed to be 1.5 to 200 times wider than a width (z) of the traverse inner barrier rib 240.

In addition, the outer barrier ribs that are partially overlapped in the non-display region can be the longitudinal outer barrier rib 263 and the traverse outer barrier rib 273 as in the third embodiment.

Figure 9:
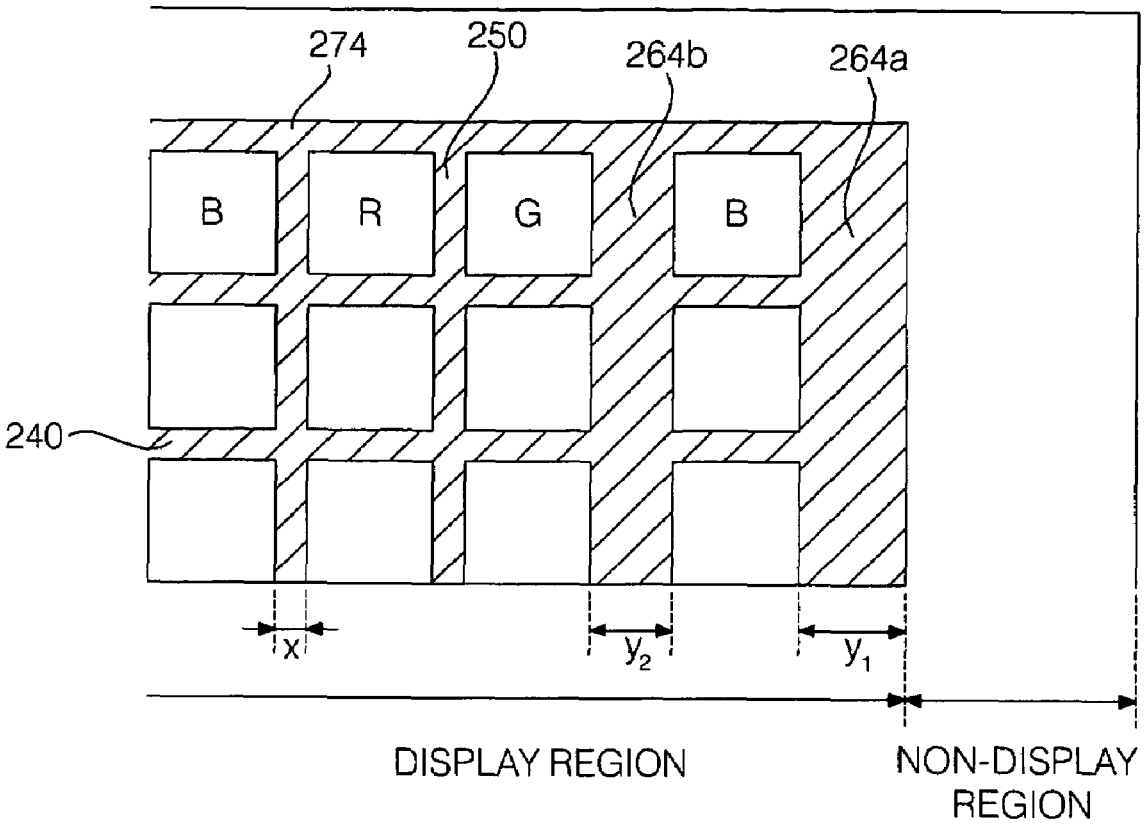
FIG. 9 shows a fifth embodiment of a plasma display panel according to the present invention.

FIG. 9 is a view for illustrating a barrier rib structure according to a fifth embodiment. In FIG. 9, outer barrier ribs 264*a*, 264*b* having a width greater than that of a longitudinal inner barrier rib 250 within a display region include a first longitudinal outer barrier rib 264*a* and a second longitudinal outer barrier rib 264*b*, and a traverse outer barrier rib 274 having the same width as that of traverse inner barrier ribs 240 within the display region.

In the above, a width (y1) of the first longitudinal outer barrier rib 264*a* close to an outer block of the display region is formed to be wider than a width (y2) of the second longitudinal outer barrier rib 264*b*.

That is, in the case where the outer barrier ribs 264*a*, 264*b* having a width greater than that of the inner barrier ribs 240, 250 are formed as plural lines, the widths (y1, y2) of the outer barrier ribs can be wider with the outer barrier ribs becoming more distant form the center of the rear substrate.

The first and second longitudinal outer barrier ribs 264*a*, 264*b* refer to barrier ribs located at the right outer block of the rear substrate. Therefore, longitudinal outer barrier ribs (not shown) located at the left outer block of the rear substrate, which correspond to the first and second longitudinal outer barrier ribs 264*a*, 264*b*, will have substantially the same width as the widths (y1, y2) of the barrier ribs, and can also be formed as two or more lines.

A manufacturing method of the barrier rib structure according to the first to fifth embodiments may employ a screen printing method, an addition method, a photosensitive paste method, a Low Temperature Cofired Ceramic on Metal (LTCCM) method, a sandblasting method, a chemical etching method and the like. However, the present invention is not limited to the above methods, but can include any other methods.

As described above, in accordance with a plasma display panel according to the present invention, outer barrier ribs are located in a display region and have a width greater than that of barrier ribs located at a central portion. Therefore, this can obviate a manufacturing process of a SBR, which was located in a non-display region in the related art. It is also possible to prevent noise occurring in a panel due to steps in a SBR and between barrier ribs.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. A plasma display panel, comprising:

a plurality of discharge spaces;

a rear substrate; and a plurality of barrier ribs partitioning the plurality of discharge spaces, the plurality of barrier ribs comprising two parallel outer barrier ribs separated by at least one of the plurality of discharge spaces, the two parallel outer barrier ribs formed on an outer region of the rear substrate, and a plurality of inner barrier ribs having a common width formed on an inner region of the rear substrate, wherein the two parallel outer barrier ribs each have a width greater than the common width of the plurality of inner barrier ribs, an outermost of the two outer barrier ribs having a substantially uniform width wider than a substantially uniform width of an inner rib of the two outer barrier ribs, and wherein the outermost of the two outer barrier ribs borders a discharge space formed in an outermost block of a display region of the plasma display panel.

2. The plasma display panel as claimed in claim 1, further comprising:

a traverse outer barrier rib arranged orthogonally to the parallel two outer barrier ribs.

3. The plasma display panel as claimed in claim 1, wherein the two parallel outer barrier ribs have a height substantially the same as a height of the plurality of inner barrier ribs.

4. The plasma display panel as claimed in claim 1, wherein the width of at least one of the two parallel outer barrier ribs is set in the range of 45 μm to 30000 μm.

5. The plasma display panel as claimed in claim 1, wherein the width of at least one of the two parallel outer barrier ribs is set to be 1.5 to 200 times wider than the width of the plurality of inner barrier ribs.

6. The plasma display panel as claimed in claim 1, wherein a side of the at least one outer barrier rib is not coated with phosphors.

7. A plasma display panel, comprising:

a plurality of discharge spaces;

a rear substrate; and a plurality of barrier ribs partitioning the plurality of discharge spaces, the plurality of barrier ribs comprising an outer barrier rib formed on an outer region of the rear substrate and a plurality of parallel inner barrier ribs formed on an inner region of the rear substrate, wherein the outer barrier rib has a width greater than a width of each of the plurality of parallel inner barrier ribs, wherein the outer barrier rib borders a discharge space formed in an outermost block of a display region of the plasma display panel, wherein the outer barrier rib has a substantially uniform width and is disposed on the display region or only a portion of the outer barrier rib is disposed on the display region, and wherein a height of the outer barrier rib is shorter than a height of the plurality of parallel inner barrier ribs.

* * * * *